United States Patent [19]

Brown et al.

[11] Patent Number: 4,870,997

[45] Date of Patent: Oct. 3, 1989

[54] LOOM WITH SELECTIVELY POSITIONABLE SHUTTLE MECHANISM

[75] Inventors: Charles M. Brown; Robert B. Doughty, Jr., both of Starkville, Miss.

[73] Assignee: Niagara Lockport Industries Inc., Quincy, Fla.

[21] Appl. No.: 214,209

[22] Filed: Jul. 1, 1988

[51] Int. Cl.[4] ..... D03D 43/06

[52] U.S. Cl. ..... 139/172; 139/182

[58] Field of Search ..... 139/11, 142, 144, 171, 139/172, 175, 178, 182 R

[56] References Cited

U.S. PATENT DOCUMENTS

| | | | |
|---|---|---|---|
| 3,954 | 3/1845 | Nield | 139/172 |
| 1,605,109 | 11/1926 | Hawk | 139/171 |
| 2,707,005 | 4/1955 | Fuchs | 139/172 |
| 3,183,942 | 3/1962 | Kondo et al. . | |
| 3,220,442 | 11/1965 | Antz et al. . | |
| 4,244,401 | 1/1981 | Gustafsson . | |
| 4,640,318 | 2/1987 | Hintsch et al. | 139/183 |

*Primary Examiner*—Henry S. Jaudon

*Attorney, Agent, or Firm*—Pettis & McDonald

[57] ABSTRACT

An improved weaving loom provides for mounting of the shuttle box assemblies and shuttle picking apparatus at any of a plurality of positions along the shuttle raceway to enable the loom to be configured to have a weaving width substantially narrower than the total width of the loom raceway.

15 Claims, 4 Drawing Sheets

LOOM WITH SELECTIVELY POSITIONABLE SHUTTLE MECHANISM

BACKGROUND OF THE INVENTION

This invention relates generally to improvements in weaving looms to provide for satisfactory weaving of fabric of selected widths that may be substantially less than the total width of the loom. More specifically, the invention relates to an improvement in such looms providing for selective positioning of the shuttle mechanism or mechanisms at various locations along the shuttle raceway.

In recent year numerous advances in weaving technology and in the construction of large, heavy duty looms has permitted the weaving of fabrics, including heavy fabrics, in ever increasing widths. Looms are now available and in use in various weaving industries, such as those relating to the weaving of papermaking fabrics, that are capable of weaving fabric of 30 meters or more in width and of indefinite length. Because of the massive size and the great strength required for the various components of such a loom, these very large looms are extremely expensive, sometimes costing many hundreds of thousands of dollars. Accordingly, it is important to have such looms in operation, producing salable fabric, to the greatest extent possible. Because only certain customers have requirements for as wide as the largest of these looms, it has been difficult to use such looms to their full capacity. The nature of weaving limits the ability of such large looms to weave fabrics substantially narrower than the total width of the loom. This is because the shuttle pulling the weft filaments back and forth across the raceway of the loom must maintain substantial tension on that weft filament at all times to provide a consistently high quality fabric. However, if weaving of a fabric substantially narrower than the total width of the loom is attempted, at each reversal of the shuttle's movement, there is a brief period when the weft goes slack, thus increasing the potential for unsatisfactory weaves.

In known looms there has been little that can be done about this problem because of the massive apparatus that is needed to support and move the shuttle box assembly, which has required that the shuttle box assemblies remain positioned adjacent the extreme ends of the loom. Thus, the very largest and most expensive looms frequently experience the lowest rates of utilization in a weaving mill.

SUMMARY OF THE INVENTION

In order to overcome the disadvantages of present looms, as described above, the present invention provides an improvement in such looms to enable the weaving of commercially satisfactory fabrics of selected widths substantially less than the total length of a particular loom. More particularly, this invention provides for such an improved loom having a selectively positionable shuttle mechanism that may be positioned at any of a plurality of locations along the loom raceway. To achieve these and other objects of the invention that will become apparent to those skilled in the art, there is provided an improvement in a loom having a shuttle raceway extending across the weaving path of the loom between opposite ends of the loom weaving surface and in which a shuttle moves reciprocatingly across the raceway between two shuttle box assemblies. The shuttle is propelled by picking apparatus positioned adjacent each such shuttle box assembly and the loom includes support structure for carrying the raceway, the shuttle box assemblies and the picking apparatus. This improvement comprises the loom being configured for mounting the shuttle box assemblies and the picking apparatus at any of a plurality of positions along the raceway, whereby the loom may be configured to have a weaving width substantially narrower than the total width of the raceway for weaving a fabric substantially narrower than the total width of the raceway.

BRIEF DESCRIPTION OF THE DRAWINGS

Particularly preferred embodiments of the apparatus of this invention will be disclosed in detail in connection with the drawings in which.

DESCRIPTION OF PREFERRED EMBODIMENT

Figure 1:
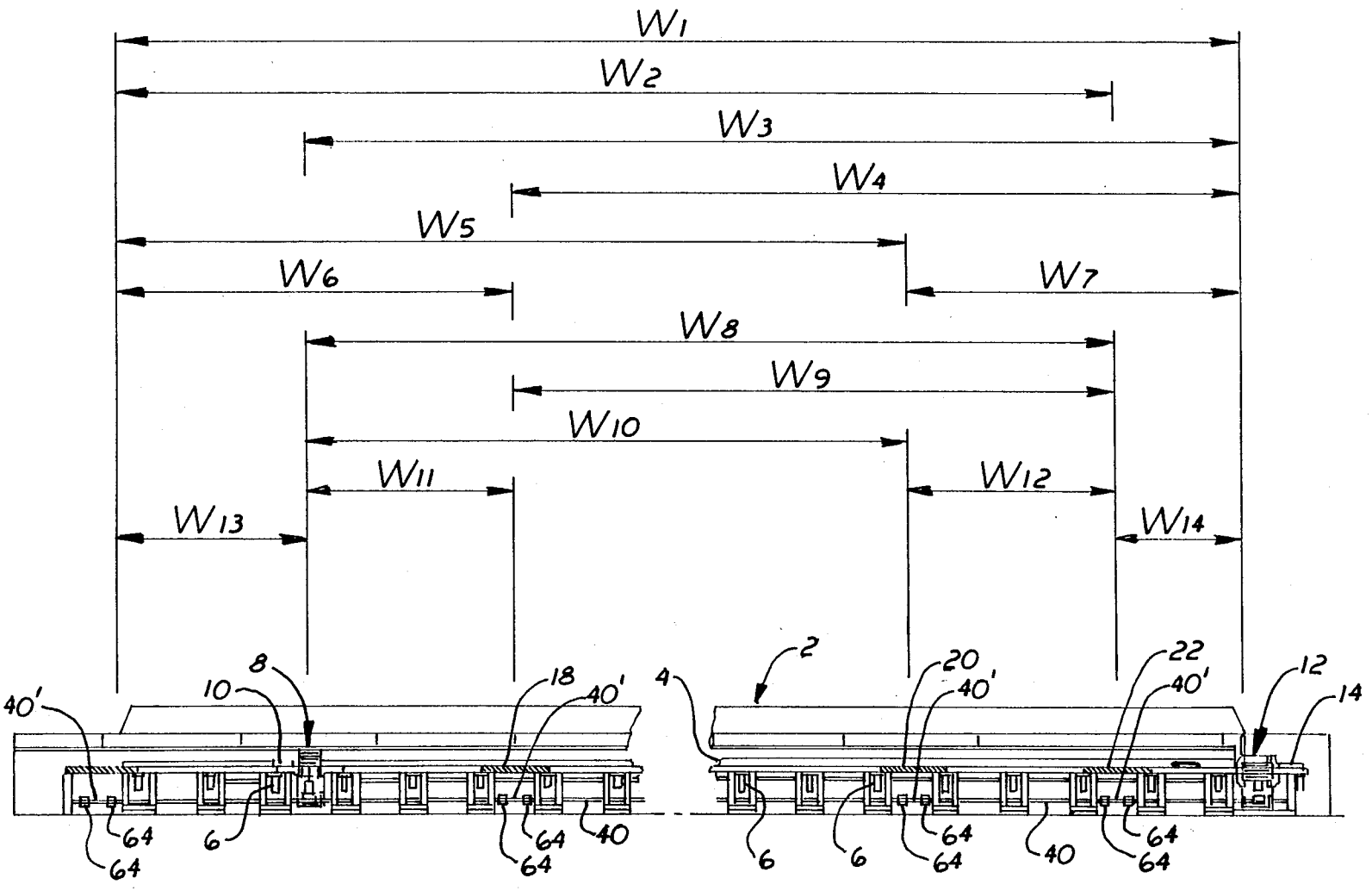
FIG. 1 is an elevational view of an improved loom according to this invention indicating various widths of fabrics that could be woven by selective positioning of the shuttle box assemblies and picking mechanisms according to the invention.

A preferred embodiment of the application of this invention is illustrated in the schematic front elevational view of FIG. 1. In that illustration a large loom 2 is illustrated. This loom may suitably be any of a number of available looms of significant width, such as a Texo type HF manufactured by Almhults Bruk in Sweden, modified in accordance with the present invention. Many of the components of this loom 2 are conventional, including the reed assembly 3 (shown in FIG. 2), the raceway 4 and support members 6 for supporting such raceway or race plate. There also are provided for the left hand side of the loom a shuttle box assembly 8 and a picking mechanism 10 along with corresponding right hand side shuttle box assembly 12 and picking mechanism 14. The shuttle box assemblies and picking apparatus are illustrated in greater detail in FIGS. 2 and 3.

In the improved loom of this invention the shuttle raceway is fabricated with at least one, and in this case a plurality, such as four, portions 16 (not shown), 18, 20 and 22 being selectively removable in the illustration of FIG. 1. The selectively removable raceway portion 16 is not shown, because the loom is illustrated as having that portion already removed and the shuttle box and picking mechanism assemblies 8 and 10 mounted in place of that raceway portion 16.

Figure 2:
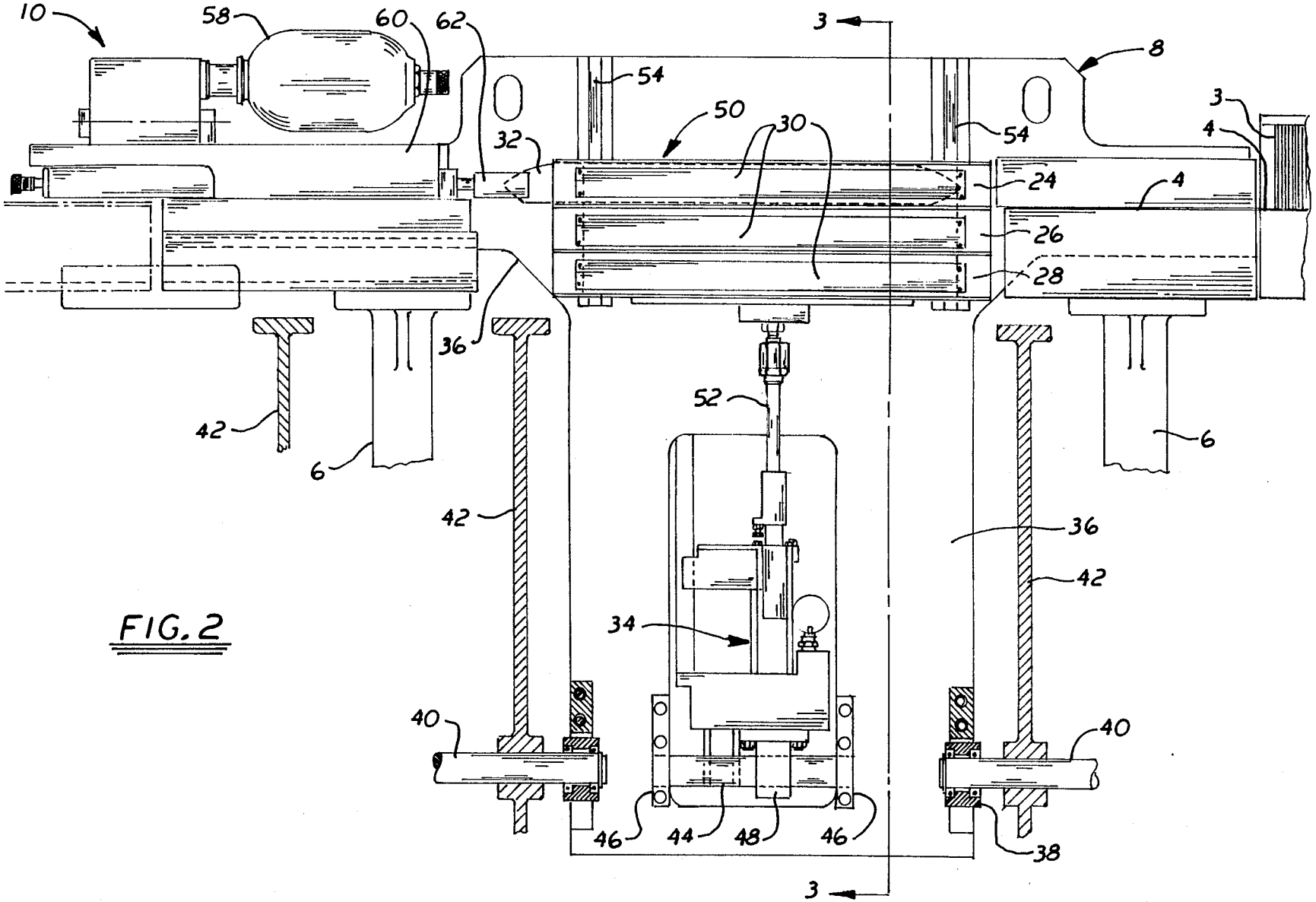
FIG. 2 is an elevational view, at a larger scale, of a shuttle box assembly and picking mechanism incorporated into the improved loom of FIG. 1.

The shuttle box assembly 8 and picking mechanism 10 are illustrated more clearly in the enlarged fragmentary view of FIG. 2. While this figure illustrates the shuttle box assembly 8 and picking mechanism 10 associated with the left hand side of the loom in FIG. 1, it is to be understood that the shuttle box assembly 12 and picking mechanism 14 are substantially identical in structure and function, but reversed in orientation for use on the right hand side of the loom.

This shuttle box assembly 8 includes a plurality (three in this preferred embodiment) of shuttle cells 24, 26 and 28, each of which include a shuttle braking mechanism 30, for stopping movement of a shuttle 32 received therewithin after its passage along the raceway. A conventional and well known mechanism 34, such as an air cylinder, is provided for selectively moving the respective shuttle cells to bring a chosen such cell 24 into alignment with the path of a shuttle 32 moving along the raceway for receiving the shuttle. Selectively, this shuttle box 24 may be moved out of the shuttle receiving position in alignment with the shuttle path to another position, such as by generally vertical movement in the illustration of FIG. 2, so that one of the other shuttle cells 26 and 28 may then be moved into shuttle receiving position. The controls for this shuttle cell moving mechanism may conveniently be any of those types of structures that are conventional and well known in the art. The shuttle cell moving mechanism 34 conveniently may be mounted to backing member 36 that is supported by the loom structure. As shown most clearly in FIG. 2, this backing member 36 may be mounted to the overall loom structure by a pivotal mounting comprising bearing blocks 38 affixed to the backing member 36 and having journaled therewithin portion of the shaft 40 that is carried by the main supporting frame 42 of the loom. This journalling enables the backing member 36 to pivot about the axis of that shaft 40 during the beating-up action of the loom, as indicated by the angled broken line representation of FIG. 3. Actuating mechanism 34 is, in turn, mounted to the backing member 36. Conveniently, this mounting may be by means of a shaft 44 affixed by suitable brackets 46 to backing member 36 and received through a journal 48 that may be positioned at the lower end of the actuating mechanism 34.

Figure 3:
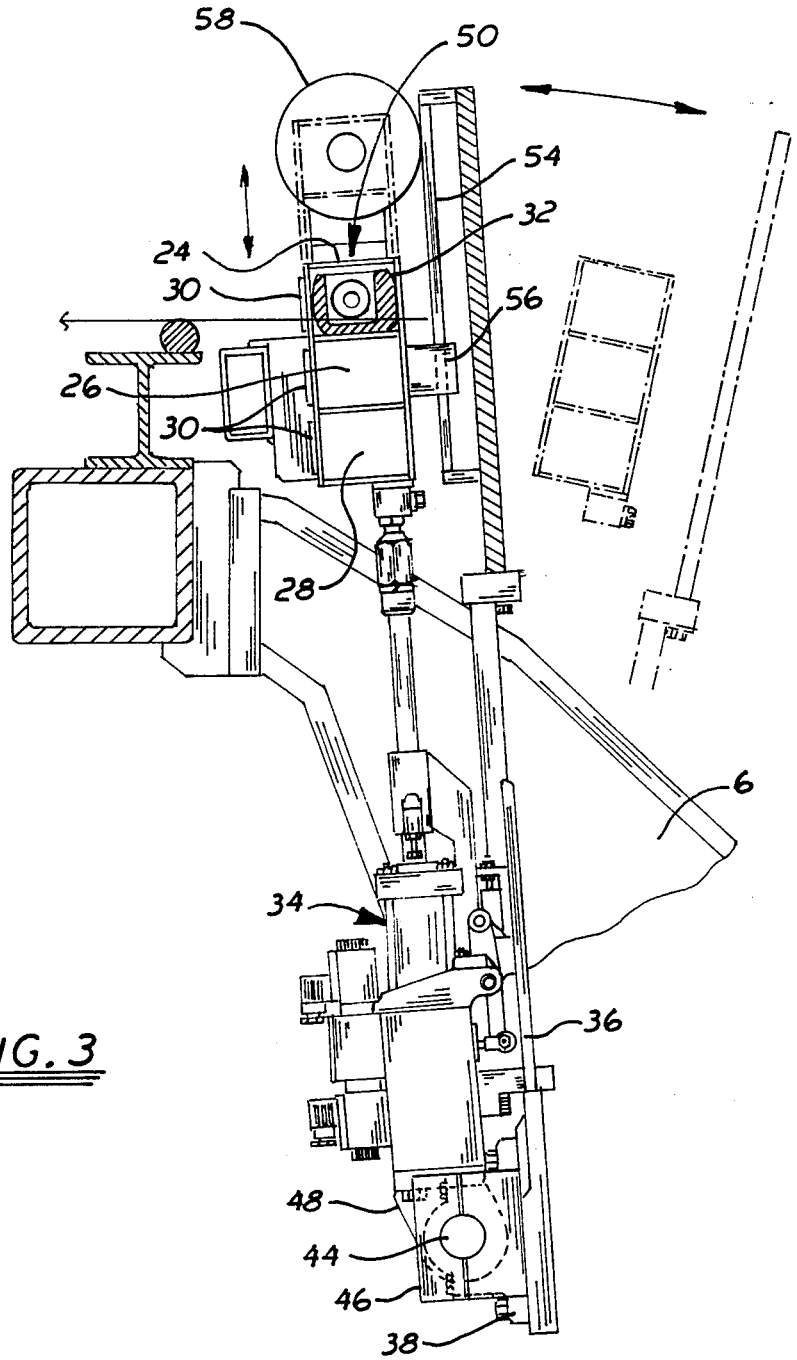
FIG. 3 is a side sectional view of the shuttle assembly taken along line 3—3 of FIG. 2.

As shown in FIGS. 2 and 3 the shuttle cells 24, 26 and 28 that comprise a portion of the shuttle box assembly preferably are joined together to form a substantially unitary three cell shuttle box, generally indicated by reference numeral 50. Conveniently, an actuator portion, such as piston rod 52 of the actuator assembly 34 is affixed in a conventional manner to the shuttle box 50, suitably adjacent the bottom thereof. This shuttle box 50 is also supported for reciprocating movement generally parallel to backing member 36 by conventional means such as guide members 54 affixed to the backing member 36 and slides 56, such as ball bushings, affixed to the shuttle box 50. This provides for smooth and relatively low friction reciprocating movement of the shuttle box 50 parallel to the backing member 36, as indicated by the broken line representation in FIG. 3.

As best shown in FIG. 2, the support members 6, in addition to supporting a portion of the raceway 4, also support the picking mechanism 10. These supports 6 are also mounted to the loom for pivoting movement during the beating-up process, suitably by means of bearing blocks engaging shafts 40 in the manner similar to that described with respect to the backing member 36. This is conventional in loom construction and is not illustrated in detail. This picking mechanism 10 suitably may comprise an accumulator chamber connected to a conventional source of pressurized fluid and connected in turn to a fluid operated cylinder 60, which may be either hydraulic or pneumatic, with the actuating piston rod of that cylinder 60 having on its outer end a picking member 62 for engaging and launching the shuttle 32 along with raceway 4 under the influence of pressurized fluid released from the accumulator 58 into the cylinder 60. Cylinder 60 may also be attached to backing member 36 in a conventional manner so that both the picking mechanism cylinder 60 and the shuttle box assembly 8 will move in unison during the beating-up process. As indicated in FIG. 3, actuation of the shuttle box actuating mechanism 34 can serve to align any of the shuttle box cells 24, 26 or 28 with the cylinder 60 and picking member 62 so that a shuttle held in any one of those shuttle cells may be launched along the raceway 4 when desired.

Some of the advantages of the loom construction of this invention are illustrated in FIG. 1. By providing the shaft 40 with conventional couplings connecting short removable sections of that shaft 40, with the remainder thereof, any one of those sections 40, may be removed ±or mounting of the backing member 36 in its place, in the manner illustrated in detail in FIG. 2. Thus, by providing the selectively removable portions 16, 18, 20 and 22 of the raceway generally superjacent those removable shaft portions 40,, any one of those raceway sections and the corresponding shaft sections may be removed and the shuttle box assembly 8 and picking mechanism 10 illustrated in FIGS. 2 and 3 may be inserted therefor, to define the effective left hand side of the weaving path of the loom. Correspondingly, the right hand side of shuttle box assembly 12 and picking mechanism 14 may conveniently be equivalent to a mirror image of the left hand side shuttle box assembly and picking mechanism illustrated in FIGS. 2 and 3. Thus, this right hand side of shuttle box assembly 12 and picking mechanism 14 may also be inserted in place of any of the removable raceway section and shaft portion to position the effective right hand side of the weaving path at any of those positions. Thus, the total width of the weaving path for this one loom may easily be changed to any of those widths W-1 through W-14 shown on FIG. 1 while maintaining the necessary tension in the weft filament during the weaving process and thus maintaining -he quality of the weave. In this manner even a very large loom, such as one having a weaving surface width of 30 meters or more may enjoy far greater utilization, because it may conveniently be adapted for weaving fabrics of many different, smaller widths of the weaving path. This is a major advantage not possessed by conventional looms in which the shuttle box assemblies and picking mechanisms are permanently mounted to the extreme ends of the weaving path.

Figure 4:
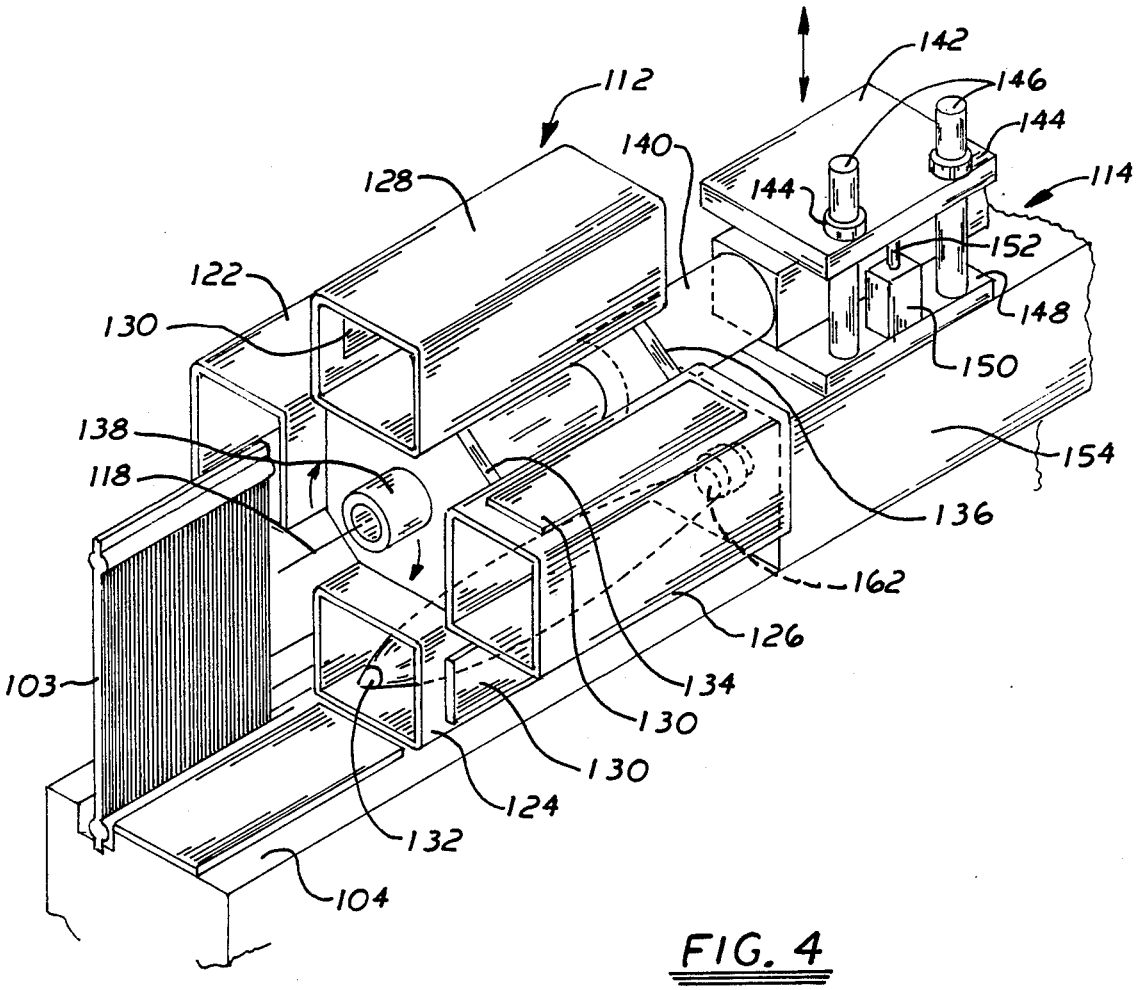
FIG. 4 is an alternative shuttle box assembly and picking mechanism for use on the improved loom of FIG. 1 in place of that illustrated in FIGS. 2 and 3.

In the fragmentary perspective view of FIG. 4, there is illustrated a second preferred embodiment of the improved loom of this invention. While this embodiment is illustrated as the unit for the right hand end of the loom 2 of FIG. 1, in place of shuttle box assembly 12 and picking mechanism 14, it is to be understood that a unit that is generally a mirror image of this same unit could be used on the left hand side of the loom, in place of shuttle box assembly 8 and picking mechanism 10. This additional embodiment has the added advantage of being usable without requiring the removal of any section of the loom frame or raceway. Thus, this improved structure may be incorporated as a portion of either conventional looms or looms having removable raceway sections as with the previously described embodiment.

In this second embodiment a plurality of shuttle box cells (in this case, four) is provided in which each of the cells is spaced radially about a predetermined axis 118 that extends through the shuttle box assembly. Preferably, as shown, each of the shuttle cells is spaced equidistant about said axis 118. The inner ends of these shuttle cells are positioned close to the outer end of the loom reed assembly 103. Preferably, also, the shuttle cells 122, 124, 126 and 128 may be mounted to support members 134 and 136 that are carried by a shaft 138 that is collinear with axis 118 and is attached to a conventional stepping type rotary drive mechanism 140. In this embodiment in which four shuttle cells are spaced equally about and parallel to the axis 118, with one centered in each quadrant, the stepper mechanism 140 my be a conventional unit configured to effect selective rotation of the rotary motion output member or shaft 138 in 90° increments in a manner well known in the art. This stepper mechanism is affixed to a mounting member 142 that is reciprocatingly movable in the direction shown by the arrows adjacent that member 142, preferably in a generally vertical direction toward and away from the raceway 104. Such movement may be guided by affixing to the mounting member 142 a plurality of guides 144, such as ball bushings, that translatingly engage guide members 146 that are affixed to member 148. Also affixed to member 148 may be an actuator 150, such as a conventional pressurized fluid actuated cylinder having a piston rod 152 that moves in a direction toward and away from the mounting member 148. The upper end of this piston rod is attached to the rotary actuator mounting member 142 so that extension of the piston rod 152 will raise the member 142, its attached rotary actuator 140 and thus the plurality of shuttle cells away from the raceway 104, for purposes to be described below. Thus, in this embodiment the shuttle box assembly comprises, essentially, the plurality of shuttle cells, the rotary drive and mount, and the supporting and actuating apparatus for carrying that rotary drive and moving it toward and away from the raceway 104 by preselected distances. This shuttle box assembly 112 may conveniently be affixed to a housing 154 that is removably attachable at any of a plurality of preselected positions longitudinally of the raceway 104. This housing 154 may be so selectively and removably attached to the raceway 104 by either clamps or bolts or other conventional structure.

Suitably carried within the housing 154 may also be a picking mechanism utilizing a pressurized fluid cylinder generally similar to the cylinder 60 illustrated in FIG. 2 with respect to the previous embodiment. A picking member 162 is shown in phantom in FIG. 4 engaging the end of a shuttle 132 in a manner exactly analogous to that illustrated in FIG. 2. By actuation of the picking cylinder and its picking member 162, the shuttle 132 carried within shuttle cell 124 may be launched along the raceway 104.

Operation of the shuttle box assembly of the embodiment of FIG. 4 may now be seen. At such time as it is desired to utilize a shuttle other than shuttle 132 that is received within the shuttle cell 124 aligned with the raceway 104, another shuttle cell, such as cell 126, may be provided with an additional shuttle and brought into position with respect to the raceway 104 as follows:

At a time when the beating up motion of the loom is stopped, the actuator 150 may be energized to urge the piston rod 152 generally upwardly, lifting the member 142 and its attached rotary actuator 140, along with the mounted shuttle cells, generally upwards and away from the raceway 104 by preselected distances. This distance need only be that sufficient to permit rotation of the mounted shuttle cell about the axis 118 without interference between any portion of such a shuttle cell and the raceway 104. As the stepper mechanism 140 is actuated, the entire assembly of shuttle cells is rotated, suitably 90°. This then brings the shuttle cell 126 into a position aligned with and spaced slightly above raceway 104. Then the actuator 150 is de-energized, or energized in the opposite direction, bringing the entire shuttle box assembly down into a position where shuttle cell 126 is aligned in just the position previously occupied by shuttle cell 124 as has been illustrated in FIG. 4. At this time a shuttle within that shuttle cell 126 is also aligned with the picking member 162 so that actuation of the picking mechanism (not shown in this embodiment) will launch the shuttle from cell 126 reciprocatingly along the raceway 104.

For clarity of illustration the various hoses or cables bringing pressurized fluid or electric current to the various actuating members and elements have been omitted, because such structures are conventional and well known in the art, as are the devices utilized for controlling such actuators and synchronizing them with movement of the loom. Obviously, corresponding further actuation of the various elements of the embodiment of FIG. 4 may serve to bring other of the shuttle cells into alignment with the raceway 104.

For each of the shuttle cells 24, 26 and 28 in the embodiment of FIG. 2 and the shuttle cells 122, 124, 126 and 128 in the embodiment of FIG. 4, there is provided a braking mechanism for halting movement of a shuttle that is received within that cell. This braking mechanism is generally illustrated by the reference numeral 30 in FIG. 2 and the reference numeral 130 in FIG. 4. Such braking mechanism may suitably comprise, in general terms, an inflatable bladder extending through at least one wall of each such shuttle cell and having a leather member attached thereto. By this structure inflation of the bladder will urge the leather member inwardly of the shuttle cell, thus providing for frictional engagement and thus braking of movement of a shuttle, such as shuttle 32 or shuttle 132. Upon release of the pressure effecting inflation of that pressurized bladder, the shuttle cell is then free to move generally longitudinally of the shuttle cell for subsequent launching back in the direction from whence it came. By using such pressurized fluid bladder for the braking mechanism, the only structure necessary for connecting that braking mechanism to the remainder of the loom is a set of flexible hoses connected to a controllable supply of pressurized fluid. Likewise, the operation of the remainder of the shuttle box assembly and the picking apparatus conveniently is effected by such pressurized fluid carried through flexible hoses. This provides for convenient positioning of this apparatus at any of the selected locations along the weaving width of the loom.

While the foregoing has described two particularly preferred embodiments of the apparatus of this invention, it is to be understood that numerous other embodiments, all within the scope of this invention will readily occur to those skilled in the art. Accordingly, the foregoing is meant to be illustrative only of the principles of the invention and is not to be considered limitative thereof. The scope of this invention is to be defined solely by the claims appended hereto.

What is claimed is:

1. In a loom having a shuttle raceway extending across the weaving path of the loom between opposite ends of the loom weaving surface and in which a shuttle moves reciprocatingly across said raceway between two multiple cell shuttle box assemblies, said shuttle being propelled by picking apparatus positioned adjacent each said shuttle box assembly, each said multiple cell shuttle box assembly having a plurality of shuttle cells with each said cell being mounted for selective movement between a position in alignment with the path of a shuttle moving along said raceway and at least one position out of alignment with the path of said shuttle along said raceway, said loom including support structure for carrying said raceway, said shuttle multiple cell box assemblies and said picking apparatus, the improvement comprising.

said loom being configured for mounting said multiple cell shuttle box assemblies and said picking apparatus at any of a plurality of positions along said raceway, whereby the loom may be configured to have a waving width substantially narrower than the total width of the raceway for weaving a fabric substantially narrower than the total width of the raceway.

2. The improved loom of claim 1 wherein said raceway includes at least one selectively removable portion thereof and wherein at least one said shuttle box assembly and one said picking apparatus are configured such that, when said raceway portion is removed, said shuttle box assembly and said picking apparatus may be mounted in place thereof.

3. The improved loom of claim 2 wherein said raceway includes a plurality of said selectively removable portions thereof, whereby said shuttle box assembly and said picking apparatus may be mounted to said loom support structure in place of any such selected raceway portion to provide for weaving of fabrics of any of a plurality of selected widths.

4. The improved loom of claim 2 wherein both said shuttle box assemblies and said picking apparatus are configured such , that either may be mounted to said loom support structure in place of said raceway removable portion.

5. The improved loom of claim 4 wherein said raceway includes a plurality of said selectively removable portions thereof, whereby each said shuttle box assembly and said picking apparatus may be mounted to said loom support structure in place of a respective one of said raceway portions to provide for weaving of fabrics of any of a plurality of selected widths.

6. The improved loom of claim 1 wherein said shuttle box assemblies are configured for attachment to said loom in engagement with said raceway.

7. The improved loom of claim 6 wherein said shuttle box assemblies are attachable to said loom in engagement with an upward facing surface of said raceway.

8. The improved loom of claim 1 wherein each of said shuttle cell positions is located above said raceway.

9. The improved loom of claim 8 wherein each of said shuttle cells is spaced radially about a predetermined axis extending through said shuttle box assembly.

10. The improved loom of claim 9 wherein each of said shuttle cells is spaced equidistant about said axis.

11. The improved loom of claim 1 wherein said selective movement comprises rotary movement about said axis.

12. For a loom having a shuttle race and at least one shuttle box cell on one side of the weaving path of the loom and a plurality of shuttle box cells on the other side of said weaving path for receiving and launching shuttles along the shuttle raceway, a rotary shuttle box changing apparatus comprising a rotary drive having a rotary motion output member rotatably driven to predetermined angles of rotation about an axis extending through said output member;

said plurality of shuttle box cells being mounted to said rotary motion output member at spaced locations about said axis, such that predetermined rotation of said output member about said axis will being a selected one of said shuttle box cells into potion for alignment with said shuttle raceway for receiving and launching a shuttle along said shuttle raceway; and a shuttle box drive support carrying said rotary drive and being attachable to said loom, said shuttle box drive support comprising means for moving said rotary drive preselected distances toward and away from said shuttle raceway, whereby movement of the rotary drive away from the shuttle raceway provides for space between the shuttle boxes mounted to the rotary drive output memeber and the shuttle raceway to facilitate desired rotation of the output member and shuttle box cells and movement of the rotary drive toward the shuttle raceway will bring a desired shuttle box cell into alignment with the shuttle raceway for receiving and launching a shuttle.

13. The rotary shuttle ox changing apparatus of claim 12 further comprising means for attaching said shuttle box drive support at any one of a preselected plurality of positions longitudinally of said shuttle raceway of said loom.

14. The rotary shuttle box changing apparatus of claim 13 wherein said shuttle box drive support is attachable to said loom atop said shuttle raceway.

15. The rotary shuttle box changing apparatus of claim 12 comprising four said shuttle box cells each spaced equidistant from and parallel to said rotary drive output member axis and each positioned about said axis substantially 90° from the next adjacent said shuttle box.

* * * * *